US006667254B1

(12) United States Patent
Thompson, Jr. et al.

(10) Patent No.: US 6,667,254 B1
(45) Date of Patent: Dec. 23, 2003

(54) FIBROUS NONWOVEN WEBS

(75) Inventors: Delton R. Thompson, Jr., Woodbury, MN (US); David A. Olson, St. Paul, MN (US); David C. Brownlee, St. Paul, MN (US); Pamela A. Percha, Woodbury, MN (US); Myles L. Brostrom, Stillwater, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 237 days.

(21) Appl. No.: 09/716,790

(22) Filed: Nov. 20, 2000

(51) Int. Cl.[7] ..... D04H 1/56; D01F 6/62

(52) U.S. Cl. ..... 442/351; 442/340; 442/344; 442/364; 442/400; 442/409; 428/364; 428/395; 428/903

(58) Field of Search ..... 442/400, 340, 442/344, 351, 409, 364; 428/903, 364, 395

(56) References Cited

U.S. PATENT DOCUMENTS

| | | | | |
|---|---|---|---|---|
| 3,946,100 | A | 3/1976 | Davis et al. | 264/211.15 |
| 4,101,525 | A | 7/1978 | Davis et al. | 528/308.2 |
| 4,118,531 | A | 10/1978 | Hauser | 442/344 |
| 4,622,259 | A | 11/1986 | McAmish et al. | 428/171 |
| 4,988,560 | A | 1/1991 | Meyer et al. | 442/344 |
| 5,010,165 | A | 4/1991 | Pruett et al. | 528/272 |
| 5,114,631 | A | 5/1992 | Nyssen et al. | 264/6 |
| 5,186,879 | A | 2/1993 | Simons et al. | 264/211.15 |
| 5,298,694 | A | 3/1994 | Thompson et al. | 181/286 |
| 5,582,905 | A | 12/1996 | Beck et al. | 428/74 |
| 5,698,298 | A | 12/1997 | Jackson et al. | 428/198 |
| 5,711,970 | A | 1/1998 | Lau et al. | 425/72.2 |
| 5,753,736 | A | 5/1998 | Bhat et al. | 524/287 |
| 5,841,081 | A | 11/1998 | Thompson et al. | 181/286 |
| 5,866,055 | A | 2/1999 | Schwarz et al. | 264/103 |
| 5,891,567 | A | 4/1999 | Kim et al. | 428/364 |
| 5,958,322 | A | 9/1999 | Thompson et al. | 264/342 RE |
| 6,015,616 | A | 1/2000 | Simons et al. | 428/364 |
| 6,057,256 | A | 5/2000 | Krueger et al. | 442/400 |
| 2002/0102897 | A1 * | 8/2002 | Berrigan et al. | 442/327 |

FOREIGN PATENT DOCUMENTS

| | | |
|---|---|---|
| EP | 0 527 489 A1 | 2/1993 |
| JP | 55-90663 | 7/1980 |
| JP | 02104755 A | 4/1990 |
| JP | 3-45768 | 2/1991 |
| JP | 03059158 A | 3/1991 |
| WO | WO 95/32859 | 12/1995 |

OTHER PUBLICATIONS

Chem Abstracts : AN : 1999 : 806105 (see article).*

Chem Astracts : AN : 1999 : 666174.*

Chang–Meng Hsiung, "Processing–Structure–Property Characteristics of Slowly Crystallizing Engineering Polymers," TRIP, vol. 4, No. 10??, pp. 342–347, Oct. 1996.

Encyclopedia of Polymer Science and Engineering, vol. 10, pp. 239–240, 252.

* cited by examiner

*Primary Examiner*—Terrel Morris
*Assistant Examiner*—John J. Guarriello
(74) *Attorney, Agent, or Firm*—Roger R. Tamte

(57) ABSTRACT

New fibrous nonwoven webs are taught that comprise a mass of polyethylene terephthalate fibers that exhibit a double melting peak on a DSC plot: one peak is representative of a first molecular portion within the fiber that is in non-chain-extended crystalline form, and the other peak is representative of a second molecular portion within the fiber that is in chain-extended crystalline form and has a melting point elevated over that of the non-chain-extended crystalline form. Webs comprising fibers having such a morphology have a unique combination of durability and dimensional stability. The fibers are generally autogenously bonded at points of fiber intersection.

29 Claims, 8 Drawing Sheets

FIBROUS NONWOVEN WEBS

FIELD OF THE INVENTION

The present invention relates to fibrous nonwoven webs, especially those that comprise polyethylene terephthalate fibers.

BACKGROUND OF THE INVENTION

Direct formation of polymeric material into fibrous nonwoven webs by processes such as meltblowing has many advantages; but the strength properties of meltblown fibers can be less than desired. The polymer chains in meltblown fibers are generally not oriented sufficiently to provide a high level of strength properties to the fibers; see *Encyclopedia of Polymer Science and Engineering*, John Wiley & Sons, Inc., 1987, Volume 10, page 240. Meltblown fibers are typically prepared by extruding molten polymer through orifices in a die into a stream of high-velocity air which rapidly and greatly attenuates the extrudate to form generally small-diameter fibers. Much of the extension of the extrudate occurs while the polymer is above its melt temperature ($T_m$), with the result that the polymer molecules can relax some of the internal stresses generated during attenuation of the extrudate, and hence, may not achieve the rather high degree of orientation that can induce the molecules to form an ordered crystalline state.

Meltblown polyethylene terephthalate (PET) fibers are especially subject to the above tendencies. Collected PET meltblown fibers exhibit almost a total lack of crystalline orientation, because PET has a relatively high rate of relaxation, a relatively low rate of crystallization, a relatively high melt temperature, and a glass transition temperature ($T_g$) well above room temperature.

The lack of crystalline order weakens conventional meltblown PET fibers, and it also makes the fibers dimensionally unstable when exposed to elevated temperatures above their $T_g$. Some internal stresses—sometimes termed amorphous orientation, i.e., an orientation insufficient to induce crystalline order—are produced during attenuation of the meltblown extrudate and are frozen in due to rapid quenching of the melt. Later heating of a nonwoven web of the fibers can release the internal stresses and allow the polymer chains to contract, whereupon the fibers shrink. Shrinkage at elevated temperatures can approach 50% of the web's as-collected dimensions. In addition to contraction of the PET molecules upon exposure to elevated temperature, some crystallization of the molecules occurs; but this crystallization of the generally amorphous molecules actually embrittles and weakens the fibers.

The result is that while PET has a number of important advantages—for example, it does not melt or degrade when exposed to rather high temperatures such as 180 degrees C., has desired flame retardancy as compared with polyolefins, and is of relatively low cost—its use as a meltblown fiber has been limited.

Several attempts have been made to provide a more stable and useful meltblown PET fiber. U.S. Pat. No. 5,958,322 teaches a method for giving an already collected meltblown PET web increased dimensional stability by annealing the web while it is held on a tentering structure. While good dimensional stability is achieved by this technique, the process requires an extra processing step that adds expense; and greater improvement in morphology and strength would be desirable. Japanese Kokai No. 3-45768 is another teaching of heating a PET web or fabric under tension to increase crystallinity, with similar deficiencies.

U.S. Pat. No. 4,988,560 teaches a technique for orienting meltblown fibers, and achieves high-strength fibers. But the fibers described in that patent require special steps to gather and hold them into a coherent web, such as embossing the assembled fibers or adding a binder material to the assembled fibers. U.S. Pat. No. 4,622,259 similarly discusses high-strength meltblown fibers that require embossing or the like to consolidate assembled fibers into a handleable and usable web.

Japanese Kokai 90663/1980 (as described in European Patent No. 527,489, page 2, lines 36–51) teaches preparation of PET fibrous webs by a meltblown process which, in combination, uses high-pressure air blown through a narrow gap, PET polymers having an intrinsic viscosity of 0.55 or higher, and extrusion at a melt-viscosity higher than "assures good melt-blowing condition." The process is said to provide PET meltblown fabric of good properties, such as strength, hand and thermal resistance; but EP 527,489 states that the process is commercially impractical and non-uniform, and that the fibers prepared lack adhesion with one another, and instead scatter during collection.

EP 527 489 itself seeks to overcome the deficiencies of the prior art by blending polyolefin into the PET polymer in an amount of 2–25 weight-percent. The polyolefin is said to become dispersed into the PET as discrete islands, resulting in a reduction in melt-viscosity, which, together with use of low-pressure air, is said to produce dimensionally stable meltblown fabrics.

U.S. Pat. No. 5,753,736 takes a different approach, using certain nucleating agents in PET to prepare meltblown PET webs having a combination of crystalline, amorphous and rigid amorphous molecular portions said to achieve shrink-resistance.

None of the above techniques is known to have resulted in actual, commercial, dimensionally stable meltblown fibrous PET webs. Despite significant prior effort, the need for such webs continues to be unsatisfied.

SUMMARY OF THE INVENTION

The present invention provides new nonwoven fibrous webs having excellent strength, durability and dimensional stability in comparison to conventional nonwoven webs. The fibers in these new webs are preferably meltblown PET fibers, and are characterized by a morphology that appears unique in such fibers. Specifically, the new fibers of the invention exhibit a chain-extended crystalline molecular portion (sometimes referred to as a strain-induced crystalline (SIC) portion), a non-chain-extended (NCE) crystalline molecular portion, and an amorphous portion. While not being bound to theoretical explanations, it is believed that the chain-extended crystalline portion in the new meltblown PET fibers of the invention provides unique, desirable physical properties such as strength and dimensional stability; and the amorphous portion in these new fibers provides fiber-to-fiber bonding: an assembly of the new fibers collected at the end of the meltblowing process may be coherent and handleable, and it can be simply passed through an oven to achieve further adhesion or bonding of fibers at points of fiber intersection, thereby forming a strong coherent and handleable web.

The unique morphology of the meltblown PET fibers of the invention can be detected in unique characteristics, such as those revealed by differential scanning calorimetry (DSC). A DSC plot for PET fibers of the invention shows the presence of molecular portions of different melting point, manifested as two melting-point peaks on the DSC plot ("peak" means that portion of a heating curve that is attributable to a single process, e.g., melting of a specific molecular portion of the fiber such as the chain-extended portion; DSC plots of PET fibers of the invention show two peaks, though the peaks may be sufficiently close to one another that one peak is manifested as a shoulder on one of the curve portions that define the other peak). One peak is understood to be for the non-chain-extended portion (NCE), or less-ordered, molecular fraction, and the other peak is understood to be for the chain-extended, or SIC, molecular fraction. The latter peak occurs at a higher temperature than the first peak, which is indicative of the higher melting temperature of the chain-extended, or SIC, fraction. We are not aware of any previous nonwoven web comprising PET fibers that exhibit dual melting peaks on a DSC plot as described, and such webs offer superior properties—e.g., combined dimensional stability and toughness—as will be further explained herein.

An amorphous molecular portion generally remains part of the PET fiber, and can provide autogenous bonding (bonding without aid of added binder material or embossing pressure) of fibers at points of fiber intersection. This does not mean bonding at all points of fiber intersection; the term bonding herein means sufficient bonding (i.e., adhesion between fibers usually involving some coalescence of polymeric material between contacting fibers but not necessarily a significant flowing of material) to form a web that coheres and can be lifted from a carrier web as a self-sustaining mass. The degree of bonding depends on the particular conditions of the process, such as distance from die to collector, processing temperature of molten polymer, temperature of attenuating air, etc. Further bonding beyond what may be achieved on the collector is often desired, and can be simply obtained by passing the collected web through an oven; calendering or embossing is not required but may be used to achieve particular effects.

In brief summary, a new PET-based web of the invention generally comprises a mass of PET fibers that a) exhibit dual melting peaks on a DSC plot representative of a first molecular portion within the fiber that is in a non-chain-extended (NCE) crystalline form, and a second molecular portion within the fiber that is in chain-extended crystalline form and has a melting point elevated over that of the NCE crystalline form, and b) are autogenously bondable.

For most uses of webs of the invention, the PET fibers preferably are of microfiber size, i.e., have an actual average diameter of 10 micrometers or less. However, larger fibers are satisfactory for many uses. Most often, the effective fiber diameter (EFD, measured by a technique that generally indicates a larger size than actual diameter) is 20 micrometers or less.

Also, for most uses, the web preferably has a density of less than 100 kilograms per cubic meter, though preferably more than 2 kg/m$^3$. The pressure drop through the web is preferably at least 0.3 mm $H_2O$ pressure drop (as measured by passing a stream of air through a 102.6-square-centimeter area at a face velocity of 3.12 meters per minute), and more preferably at least 0.5 or 1 mm water. Such a pressure drop is characteristic of webs that exhibit good sound insulation properties. Sound insulation webs generally have a density of 50 kilograms per cubic meter or less, and preferably of 25 kilograms per cubic meter or less, and are preferably at least 1 or 2 centimeters thick.

Webs of the invention are generally used in an annealed form, which provides increased stability. In contrast to prior-art PET webs which have been annealed to achieve a degree of dimensional stability, but which become embrittled and weakened by random crystal growth during the annealing process, PET webs of the invention retain good strength and durability after the annealing process. Annealed webs of the invention also have enhanced bonding, and these bonds are retained well upon heat-exposure.

Webs that combine excellent dimensional stability and excellent strength, toughness and durability have been obtained. For example, webs with a shrinkage of no more than about 2% when exposed to a temperature of 160 degrees C. for 5 minutes have been obtained. In general, webs that shrink less than 20% under such conditions can be useful, though shrinkages of 5% or less are especially useful. Also the webs of the invention retain excellent strength, toughness and durability after annealing, even when measured after a time of storage, e.g., one month at ambient conditions. Webs of the invention comprising polyethylene terephthalate fibers offer high strength, good modulus (e.g., stiffness) and good loft properties, low release of volatile organic compounds upon heating, maintenance of physical properties upon thermal and environmental exposure, relatively low flammability, formability into micro-sized diameters, and lower cost. With the heat-resistance achieved by the present invention, meltblown PET webs of greatly increased utility are provided.

Webs of the invention are prepared by a new meltblowing method. The new method comprises the steps of extruding molten PET polymer through the orifices of a meltblowing die into a high-velocity gaseous stream that attenuates the extruded polymer into meltblown fibers, and collecting the prepared fibers, briefly characterized in that the extruded molten PET polymer has a processing temperature less than about 295 degrees C., and the high-velocity gaseous stream has a temperature less than the molten PET polymer and a velocity greater than about 100 meters per second. Preferably, the PET polymer has an intrinsic viscosity of about 0.60 or less.

In some methods of the invention, other fibers are dispersed among the PET fibers before they are collected. For example, crimped and/or uncrimped staple fibers may be dispersed among the meltblown PET fibers to achieve a more lofty or a more resilient web or to assist the web to be later molded and bonded in the molded shape (webs of the invention can usually be molded without presence of staple fibers).

While the invention is particularly applicable to polyethylene terephthalate, it is also useful with other semicrystalline polymeric materials, such as polyamides, polyolefins, and other polyesters. Processes of the invention better compensate against the effects of die swell (expansion of the extrudate as it leaves the die orifice, meaning that there is less relaxation of the polymer chains in the extrudate, and that lesser relaxation, together with the strain imposed as the extrudate solidifies in the high-velocity air, results in favorable crystalline properties for these polymers also.

DESCRIPTION OF THE DRAWINGS

FIGS. 2 and 4 are the DSC plot for fiber in the web of Example 31; FIG. 2 is a plot for the fiber before annealing, and FIG. 4 is a plot for the fiber after annealing; FIG. 6 is the DSC plot for fiber in the web of Example 10; and FIG. 8 is the DSC plot for fiber in the web of Example 22.

DETAILED DESCRIPTION

Figure 1:
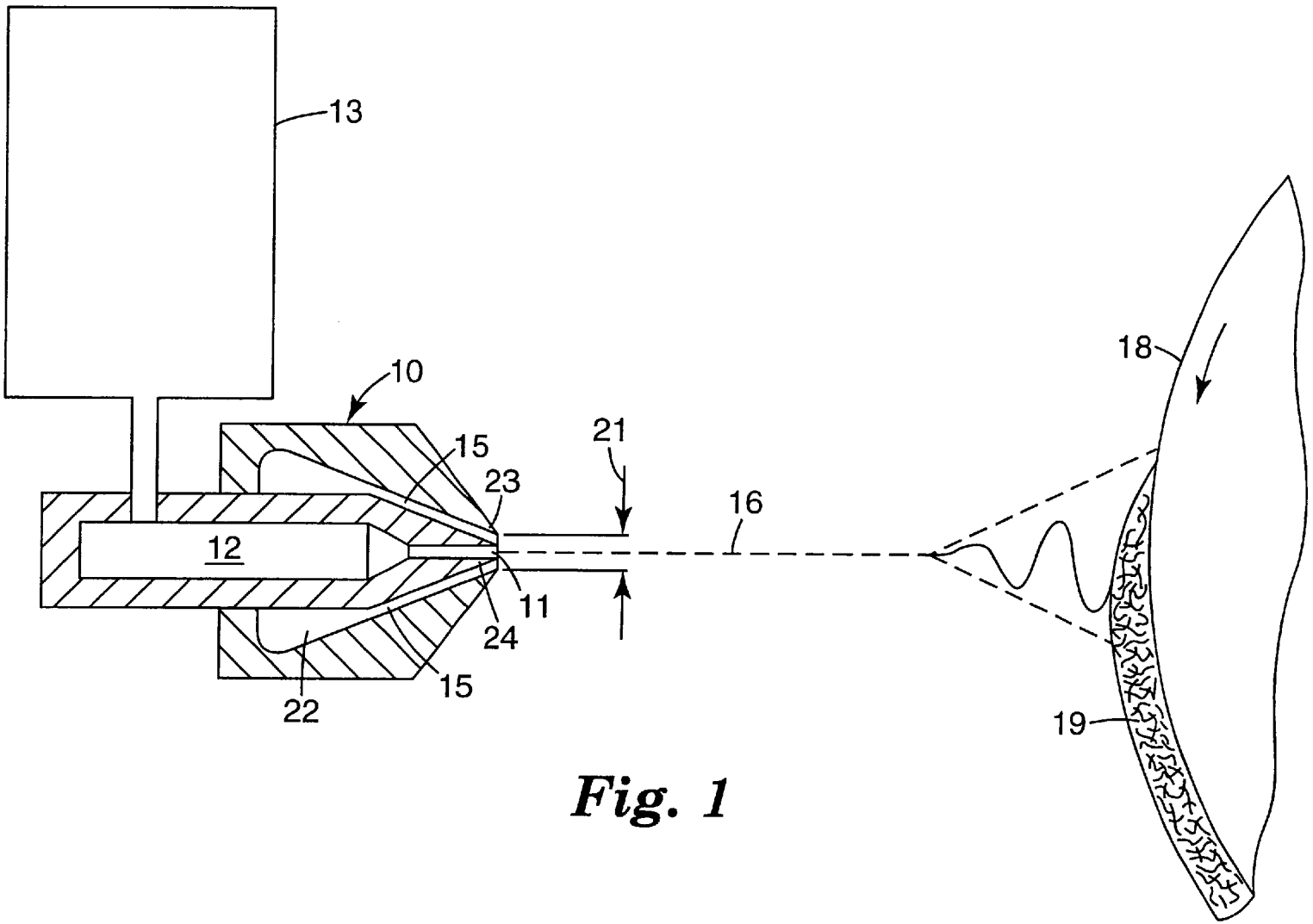
FIG. 1 is a mostly schematic diagram of apparatus useful for practicing the invention.

A representative apparatus useful for preparing meltblown fibers or a meltblown fibrous web of the invention is shown schematically in FIG. 1. Part of the apparatus, which forms the blown fibers, can be as described in Wente, Van A., "Superfine Thermoplastic Fibers" in *Industrial Engineering Chemistry*, Vol. 48, page 1342 et seq. (1956), or in Report No. 4364 of the Naval Research Laboratories, published May 25, 1954, entitled "Manufacture of Superfine Organic Fibers," by Wente, V. A.; Boone, C. D.; and Fluharty, E. L. This portion of the illustrated apparatus comprises a die 10 which has a set of aligned side-by-side parallel die orifices 11, one of which is seen in the sectional view through the die. The orifices 11 open from the central die cavity 12. Fiber-forming material is introduced into the die cavity 12 from an extruder 13. An elongated (perpendicular to the page) opening or slot 15 disposed on either side of the row of orifices 11 conveys heated air at a very high velocity. This air, called the primary air, impacts onto the extruded fiber-forming material, and rapidly draws out and attenuates the extruded material into a mass of fibers.

From the meltblowing die 10, the fibers travel in a stream 16 to a collector 18. As the meltblown fibers in the stream 16 approach the collector 18, they decelerate. In the course of that deceleration the fibers are collected on the moving collector as a web 19. The collector may take the form of a finely perforated cylindrical screen or drum, or a moving belt. Gas-withdrawal apparatus may be positioned behind the collector to assist in deposition of fibers and removal of gas, e.g., the air in which the fibers are carried in the stream 16.

Although the collected web may be coherent and handleable upon collection, the web is usually transported from the collector 18 to an oven where the web is heated to cause the fibers to further bond together at points of fiber intersection. Because of the presence of a substantial amorphous portion in the fibers of the web, including in exterior portions of the fibers, the fibers soften and adhere to achieve interfiber bonding. But because of the crystalline character of the fibers, especially the chain-extended crystalline structure, the webs show little shrinkage during the bonding operation. Also, the heat of the oven further anneals the fibers, increasing the crystalline content of the fibers, and enhancing their dimensional stability.

In general, dimensionally stable webs of the invention are achieved by controlling a number of the parameters of the meltblowing process. Two such parameters are the temperature of the polymer in the meltblowing die, i.e., the temperature of the molten polymer in the extruder 13 and die cavity 12, and the temperature of the gas, generally air, blown through the slots 15 onto the polymer extrudate. By heating the polymer in the extruder and die cavity to a temperature lower than conventionally used in meltblowing, and thereby lowering the temperature of the polymer as it exits the die orifices 11, the frost line (the point at which the molten extrudate freezes or solidifies, i.e., changes from a molten condition to a solid condition) is brought closer to the die. The result is that during attenuation of the extrudate into fibers the polymer chains tend to be straightened and oriented and to retain a substantial portion of that orientation. A portion of the straightened and oriented polymer chains are still amorphous ("amorphous orientation," in which the orientation is not sufficient to induce formation of a crystalline structure). But another portion of the polymer chains experiences sufficient stress, the "critical stress," to align the polymer chains sufficiently to facilitate a chain-extended crystalline structure. This chain-extended crystalline structure, also called strain-induced crystallization, contributes to the unique properties of meltblown fibers of the invention.

In addition to a chain-extended crystalline structure, fibers in webs of the invention generally also include some non-chain-extended (NCE) crystalline structure. This NCE crystalline structure may be initiated during original attenuation of the fibers and is increased during annealing of collected webs by crystallization of amorphous and amorphous oriented polymer chains. Crystallization of an amorphous or semi-crystalline material upon heating is termed "cold crystallization." A typical amorphous or partially crystalline PET material lacking significant orientation cold crystallizes at approximately 125° C. when it is heated. Dimensionally stable fibers of this invention that have been annealed after collection by exposure to temperatures higher than 125 degrees C. lose this cold-crystallization peak. Before annealing, the as-collected fibers generally do exhibit a cold-crystallization peak, but they are nevertheless quite dimensionally stable because of the presence of chain-extended crystalline structure.

Formation of the stated morphology is enhanced by lowering (with respect to conventional meltblowing operations) the temperature of the primary air blown through the slots 15, because air of lower temperature helps lower the temperature of the extrudate. Also, because crystallization is an exothermic event, blowing air of lower temperature onto the fibers helps remove the generated exothermic heat and assists the process of crystallization.

Preferably, the temperature of the polymer in the die cavity is held to a temperature less than about 35 degrees C. higher than the melting point of the polymer. For PET this generally means a temperature of about 295 degrees C. or less. Lower temperatures, such as 285 degrees C. or lower, are generally better; preferably the temperature is no more than about 20 degrees C. higher than the melting temperature, i.e., for PET is about 275 degrees C. or less (generally the melting point of the non-chain-extended crystalline structure of PET is regarded as the melting point of PET). The temperature of the primary air or other gas is generally less than that of the polymer in the die cavity, typically about 15 degrees C. less than the temperature of the polymer in the die cavity.

A different parameter useful in achieving dimensionally stable webs of the invention is the velocity of the primary air blown from the slots 15. The higher the velocity of that air, the greater the force applied to the extrudate, which tends to orient the polymer chains within the extrudate. Higher velocity is achieved by increasing the pressure in the supply leading to the slots 15, thus increasing the volume of air or other gas blown through the slots 15. Through analysis of exemplary processes of the invention, we have found that the primary air (or other gas) preferably has a velocity of at least 100 meters per second, and more preferably at least 150 meters per second. This velocity in feet/sec is determined by the following equation where Q is the SCFM of air flow used, P is the pressure in psi at the die exit and is assumed to have a value of 0 psi, t is the air temperature $$\text{Air velocity} = \left[\frac{Q}{\left(\frac{P+14.7}{14.7}\right)\left(\frac{530}{t+460}\right)}\right]\frac{1}{60}\cdot\frac{1}{a}$$

in degrees F, and a is the combined area of the slots 15 in square feet.

For SI units (where distances are in meters, so velocity is in meters/second, area is in square meters and Q is in SCMM; pressure is in pascals, and temperature is in degrees C), the equation is:

$$\text{Air velocity} = \left[\frac{Q}{\left(\frac{P + 1.03529 \cdot 10^5}{1.03529 \cdot 10^5}\right)\left(\frac{295.1k}{t + 273k}\right)}\right]\frac{1}{60} \cdot \frac{1}{a}$$

Another parameter that can be controlled to achieve dimensionally stable webs as well as a small effective fiber diameter is the molecular weight of the polymer, as manifested by the intrinsic viscosity of the polymer. PET polymers of a common molecular weight and intrinsic viscosity, including, for example, at least intrinsic viscosities of about 0.6–0.75, are useful in the invention. But best results in achieving microfiber-size fibers have been achieved with lower-intrinsic-viscosity polymers, e.g., about 0.50 intrinsic viscosity. The lower intrinsic viscosity allows the extrudate to be drawn to a narrow diameter. While a lower intrinsic viscosity tends to lower the forces acting within an extrudate to straighten polymer chains, sufficient chain-straightening does occur at selected polymer temperatures and primary air velocities for strain-induced crystallization to occur. However, best results in SIC and dimensional stability have presently been obtained with PET polymers of greater than about 0.45 intrinsic viscosity.

Figure 2:
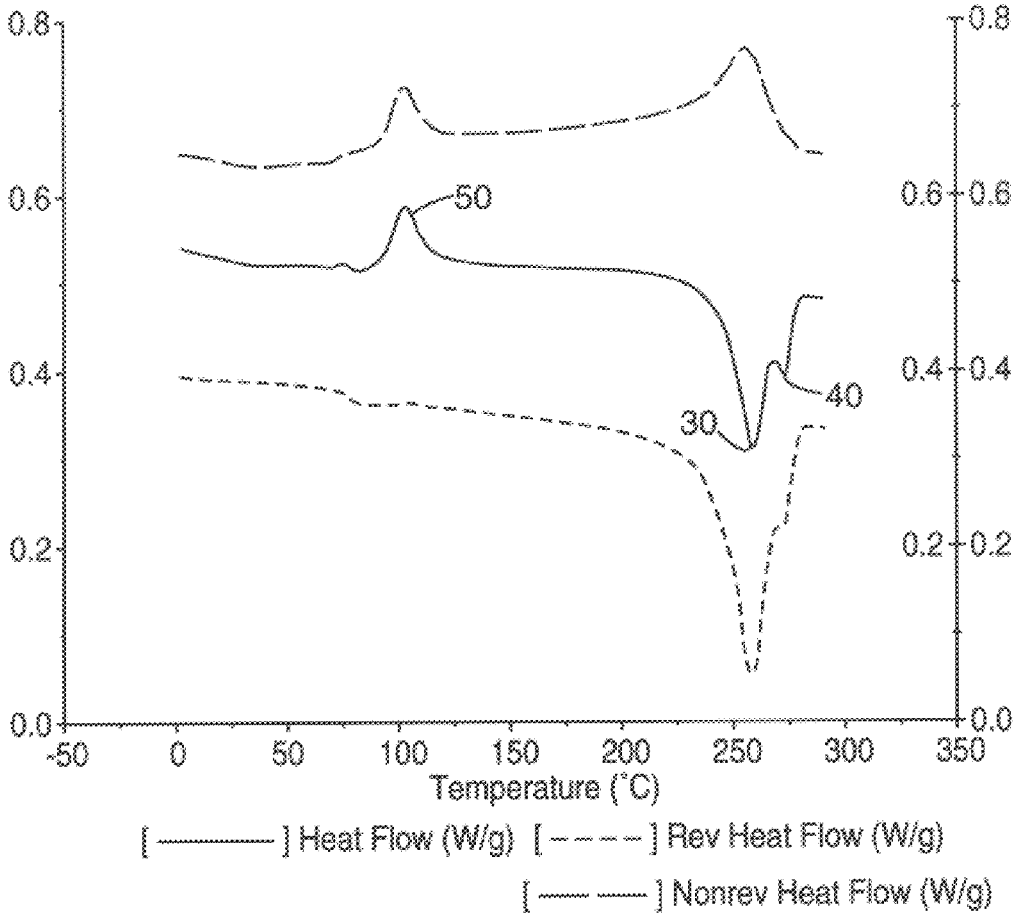
FIGS. 2, 4, 6 and 8 are plots of differential scanning calorimetry (DSC) for fibers in various of the examples described later in this specification (a particular form of DSC, known as Modulated DSC™, using an instrument supplied by TA Instruments, Inc of New Castle, Del., was conducted, and provides additional information)
Figure 4:
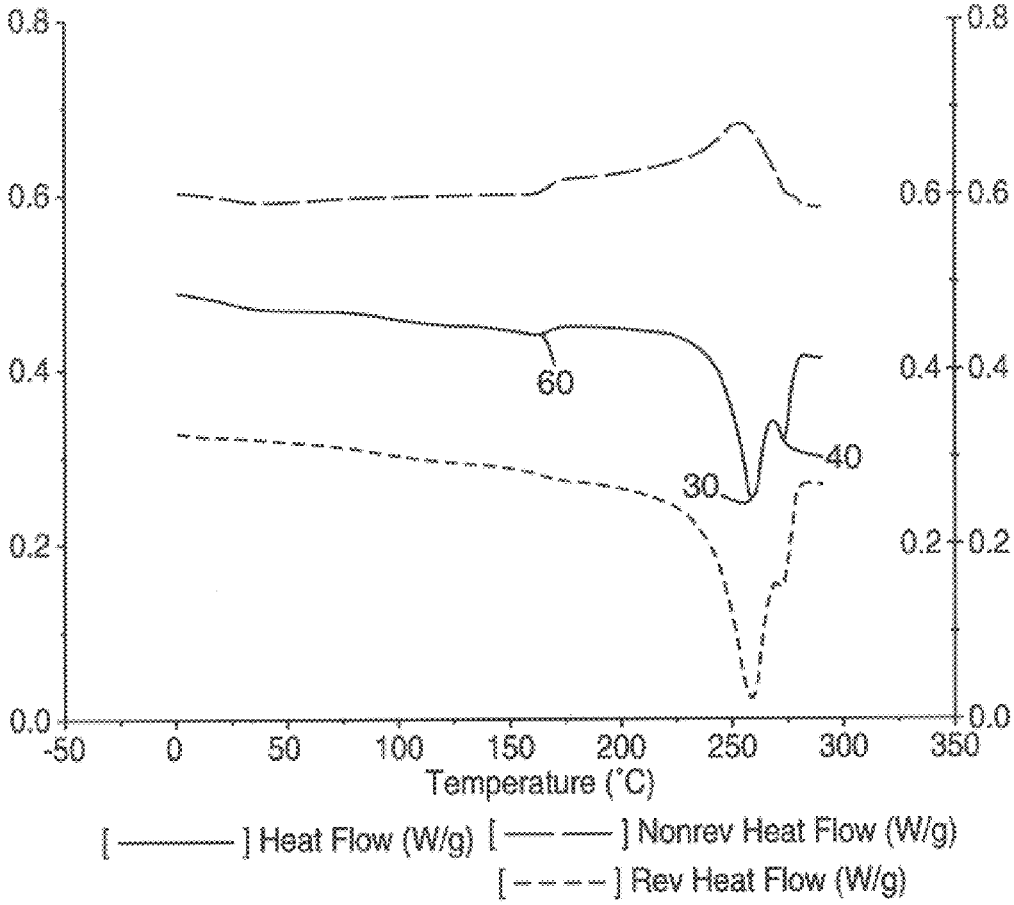

When PET meltblown fibers prepared in the manner described herein are subjected to differential scanning calorimetry (DSC; conditions for the measurements are stated in Examples 1–17), a dual-melting-peak plot is obtained such as the solid-line plots shown in FIGS. 2 and 4, which are plots for the web of Example 31 below; FIG. 2 is a plot for the unannealed web of Example 31, and FIG. 4 is a plot for the web after it was annealed for 5 minutes at 160 degrees C. As seen in both plots, there is a first endothermic peak 30, which is typically seen at 250–260 degrees C. under the described measuring conditions and which is associated with the melting of the polymeric molecular portions crystallized in a non-chain-extended (NCE) configuration. There is a second endothermic peak, or higher melting shoulder 40, which is associated with polymeric molecular portions crystallized in chain-extended or strain-induced (SIC) configuration. The chain-extended crystalline polymeric molecular portions associated with the second peak 40 have a higher melting point than the polymeric portions associated with the peak 30; the higher melting point is typically seen in the temperature range 260 to 280 degrees C.

In addition to the described chain-extended and non-chain-extended crystalline portions, the described PET fibers of the invention also include an amorphous component, which is revealed during DSC and other analysis, and which is also distinguished in that it is available for autogenous bonding of the PET fibers at points of fiber intersection. As discussed above, collected webs of fibers of the invention are sufficiently coherent that they can be removed from a collector as a handleable, integral structure. Further, when a collected web of the invention is heated in an oven to a temperature greater than $T_g$, but less than $T_m$, portions of the fiber soften and adhere at points of fiber intersection. Generally a temperature above the cold-crystallization temperature (125 degrees C. for PET) is used; a comparison of FIGS. 2 and 4 shows that the cold-crystallization peak 50 revealed in the unannealed web (FIG. 2) has been removed by the annealing/bonding operation (FIG. 4), indicating that further crystallization and ordering of molecules has occurred. Such crystallization limits remelting of bond points during later heat-exposure of the annealed and bonded web. A deflection in the DSC plot typically appears slightly above the annealing temperature, and is seen at point 60 in FIG. 4. Higher annealing/bonding temperatures, such as 160 degrees C., are desired, because they accomplish annealing/bonding in a shorter time. The bonding does not require embossing pressure, though webs of the invention may be embossed or calendered to enhance bonding or to give the web a desired configuration or other properties.

Figure 10A:
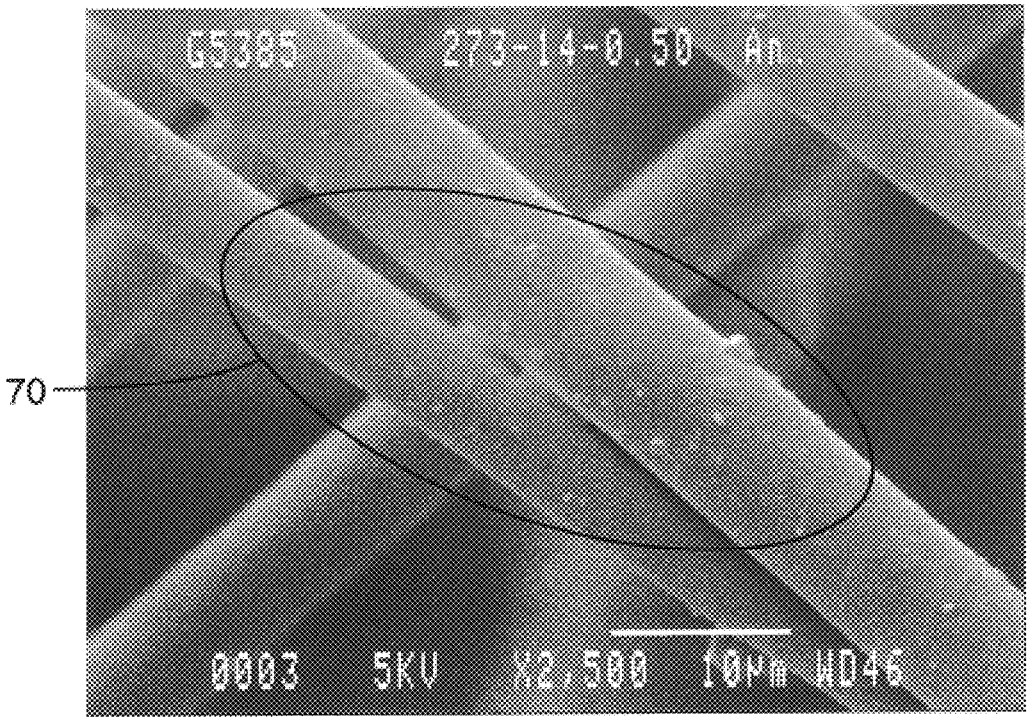
FIGS. 10*a* and 10*b* are scanning electron micrographs, at 2500X and 7500X, respectively, for a web of Example 30.
Figure 10B:
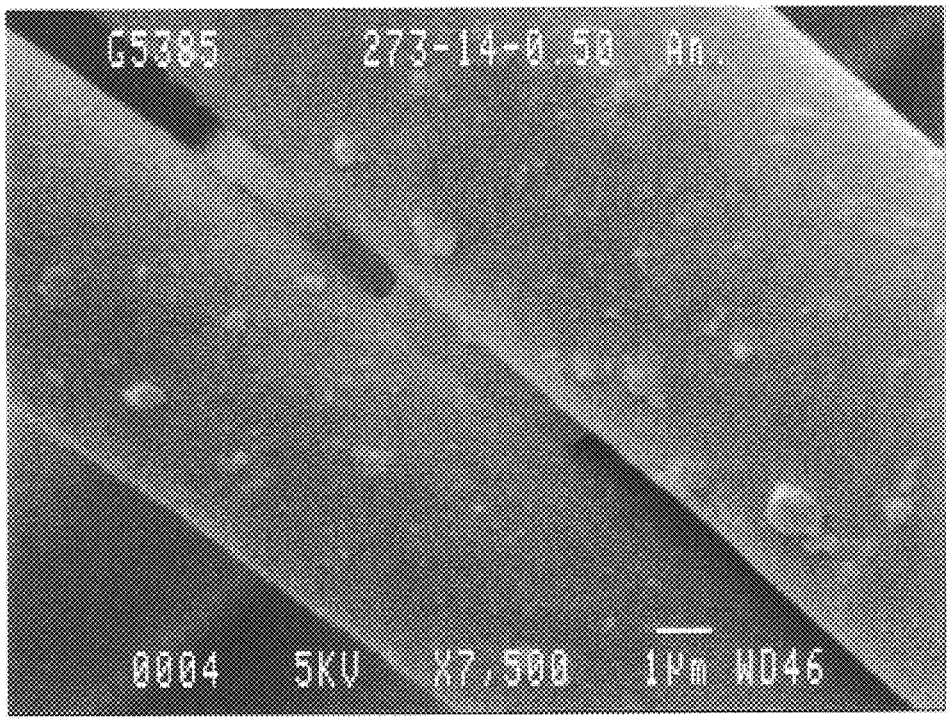

A significant portion of the amorphous content is present at the exterior circumference of the prepared fibers. The surface of the extruded filaments cool or quench faster and may experience a different stress pattern from the central portion of the filament, which may lead to formation of amorphous content at the surface. Whatever the reason, amorphous content can be revealed by the bonding that occurs in webs of the invention. FIG. 10*a* is a scanning electron micrograph of the annealed web prepared in Example 30, at 2500X, showing a bond site 70 between intersecting fibers, and FIG. 10*b* shows the same bond site at 7500X.

Figure 11A:
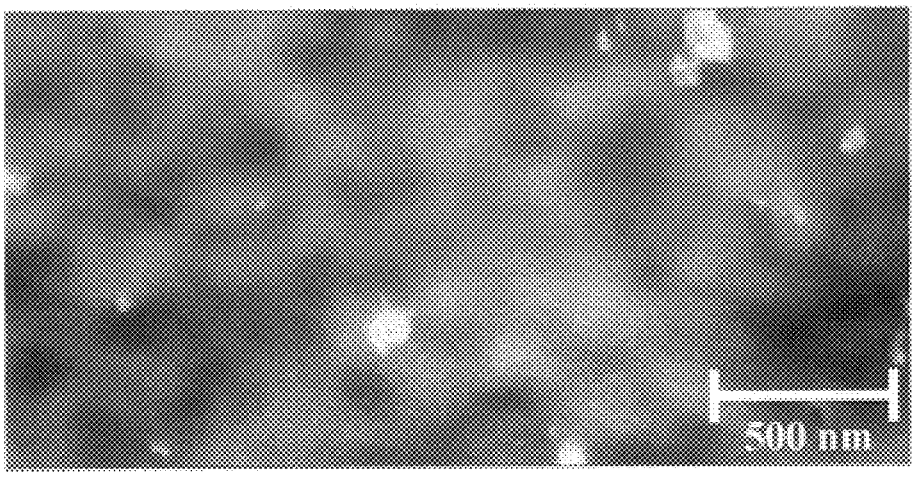
FIGS. 11*a* and 11*b* are atomic force micrographs of fiber of the invention, before etching (FIG. 11*a*) and after etching (FIG. 11*b*).
Figure 11B:
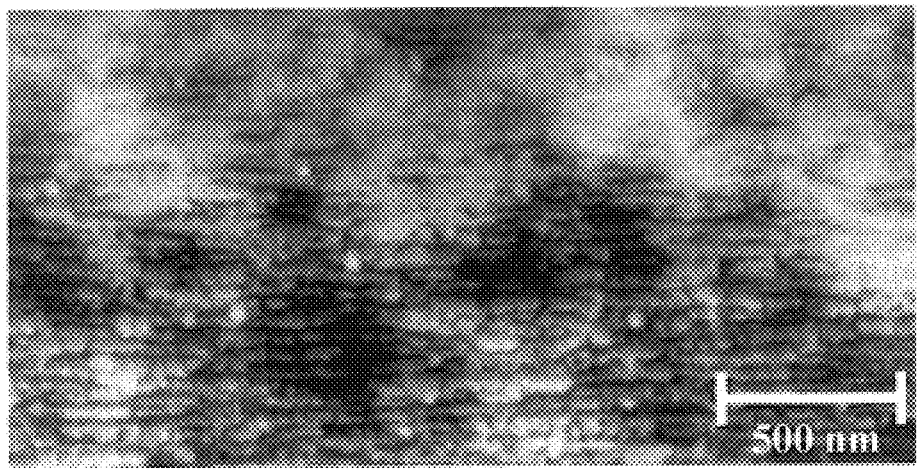

Amorphous content at the surface of the fibers is also shown by analyses such as atomic force microscopy (AFM). FIG. 11*a* is an AFM of a portion of fiber of the invention, and FIG. 11*b* is an AFM of the fiber after it has been etched with sodium hydroxide. As seen in FIG. 11*a*, before etching, the surface of the fiber is relatively smooth and glass-like, indicating amorphous content. But after etching with sodium hydroxide, which preferentially etches the exterior amorphous PET material, the surface is striated as shown in FIG. 11*b*, presumably showing the crystalline structure. The presence of the circumferential layer of amorphous polymeric PET material is advantageous to bonding of webs of the invention.

Polyethylene terephthalate is a greatly preferred polymer for use in the invention, but other polymers or materials can be blended with PET by using appropriate control of other parameters such as melt temperature and viscosity and primary air velocity. Also, by using techniques taught for example in U.S. Pat. No. 6,057,256, webs of the invention can incorporate bicomponent fibers in which PET or a related polymer is one component (extending longitudinally along the fiber through a first cross-sectional area of the fiber) and one or more other polymers are other components (extending longitudinally along the fiber through one or more other cross-sectional areas of the fiber; the term "bicomponent" herein includes fibers having two or more components). Process parameters should be controlled to develop crystallization in the PET component manifested as the noted dual-melting-peak DSC plot.

Other fibers may be mixed into a fibrous web of the invention, e.g., by feeding the other fibers into the stream of blown fibers before it reaches a collector. U.S. Pat. No. 4,118,531 teaches a process and apparatus for introducing crimped staple fibers into a stream of meltblown fibers to increase the loft of the collected web, and such process and apparatus are useful with fibers of the present invention. U.S. Pat. No. 3,016,599 teaches such a process for introducing uncrimped fibers. The additional fibers can have many functions: opening or loosening the web, increasing the porosity of the web, providing a gradation of fiber diameters in the web, increasing compression-resistance or resilience, etc.

Also, the added fibers can function to give the collected web added coherency. For example, fusible fibers, preferably bicomponent fibers that have a component that fuses at a temperature lower than the fusion temperature of the other component, can be added and the fusible fibers can be fused at points of fiber intersection to form a coherent web useful to provide enhanced web moldability (see U.S. Pat. No. 5,841,081). Also, addition of crimped staple fibers to the meltblown fiber stream can produce a coherent web, with the crimped fibers intertwining with one another and with the oriented fibers.

Some webs of the invention include particulate matter, which may be introduced into the web in the manner disclosed in U.S. Pat. No. 3,971,373, e.g., to provide enhanced filtration. The added particles may or may not be bonded to the fibers, e.g., by controlling process conditions during web formation or by later heat treatments or molding operations. Also, the added particulate matter can be a supersorbent material such as taught in U.S. Pat. No. 4,429,001. In addition, additives may be incorporated into the PET fibers such as dyes, pigments or flame-retardant agents.

In another variation, fiber streams from two or more meltblowing dies are merged; see FIG. 1 of U.S. Pat. No. 4,429,001 and FIG. 2 of U.S. Pat. No. 4,988,560. The streams may each comprise PET fibers of the present invention, or the second (or additional) stream(s) may comprise a different fiber, including a conventional meltblown PET fiber.

Webs of the invention are especially useful as insulation, e.g., acoustic or thermal insulation. Webs comprising a blend of crimped fibers and oriented melt-blown PET fibers as described herein (e.g., comprising staple fibers in amounts up to about 90 weight percent, with the amount preferably being less than about 50 weight percent of the web) are especially useful as insulation. The addition of crimped fibers makes the web more bulky or lofty, which enhances insulating properties. Insulating webs of the invention are preferably 1 or 2 centimeters or more thick, though webs as thin as 5 millimeters in thickness have been used for insulating purposes. The oriented melt-blown PET fibers described herein desirably have a small diameter, which also enhances the insulating quality of the web by contributing to a large surface area per volume-unit of material. The combination of bulk and small diameter gives good insulating properties.

Because of their dimensional stability under thermal stress, webs of the invention are particularly suited for lining chambers such as automobile engine compartments or small and large appliance housings, for example, air-conditioners, dishwashers, refrigerators, etc. The webs also have increased tensile strength and durability because of the SIC of the PET meltblown fibers, and the webs have good flexural strength. Their durability enhances their utility in insulation, providing, for example, increased resistance to wear and launderability. Other illustrative uses for webs of the invention are as acoustical dampers, filters and battery separators.

EXAMPLES 1–17

A series of meltblown, nonwoven, fibrous PET webs were prepared from PET having an intrinsic viscosity of 0.60 (3M PET resin 651000) using a meltblowing die generally as illustrated in FIG. 1. The array of orifices at the die tip was 10 inches ( 25.4 centimeters) wide, with 0.015-inch-diameter (0.381 mm) orifices aligned in a row and spaced on 0.040-inch (1.02 mm) centers. The forward edge of the tip of the die that defines the slot 15 (the point 23 in FIG. 1) was 0.049 inch (1.25 mm) in advance (further downstream) of the tip (24) that defines the orifice 11 (this is called a negative setback). The combined width of the slots 15 (the dimension 21 in FIG. 1) was set at 0.069 inch (1.75 mm), and the slots were 16 inches (40.6 centimeters) long, i.e., they extended three inches past the end of the row of orifices 11 on each side of the die. The collector was spaced 18 inches (about 46 centimeters) from the meltblowing die.

The temperature of the PET polymer in the extruder, and the temperature and pressure of the air passing through the air knife (slot 15), the primary air, were varied as shown in Table 1. Air velocity was calculated by the above-stated equation. The throughput rate of the polymer was held constant at about 1 pound/inch/hour (about 180 g/cm/hour), and the collecting surface was moved at a rate so as to produce a web of about 260 grams/square meter.

The shrinkage of as-extruded webs prepared in the examples was measured by marking a 10-inch-by-10-inch square area (25.4-centimeter-by-25.4-centimeter) on each sample, and placing the samples individually into an oven heated to 160 degrees C., where they were subjected to unrestrained heating for five minutes. The samples were removed, allowed to cool, and re-measured for dimensional changes. Results for shrinkage in both the machine direction (the direction the collector was moving during collection of the sample web) and cross direction were determined and averaged.

The average effective fiber diameter can be estimated by measuring the pressure drop of air passing through the major face of the web and across the web as outlined in the ASTM F 778-88 test method, except using a face area of 102.6 square centimeters, and a face velocity of 3.12 meters per minute. As used herein, the term "average effective fiber diameter" means that fiber diameter calculated according to the method set forth in Davies, C. N., "The Separation of Airborne Dust and Particles," Institution of Mechanical Engineers, London, Proceedings 1B, 1952. Actual average fiber diameters were also measured for some of the examples from scanning electron micrographs.

Web thickness for each example was measured in accordance with ASTM D5736 using a pressure plate force of 0.002 pound per square inch (13.8 pascal).

Results are reported in Table 1.

Figure 6:
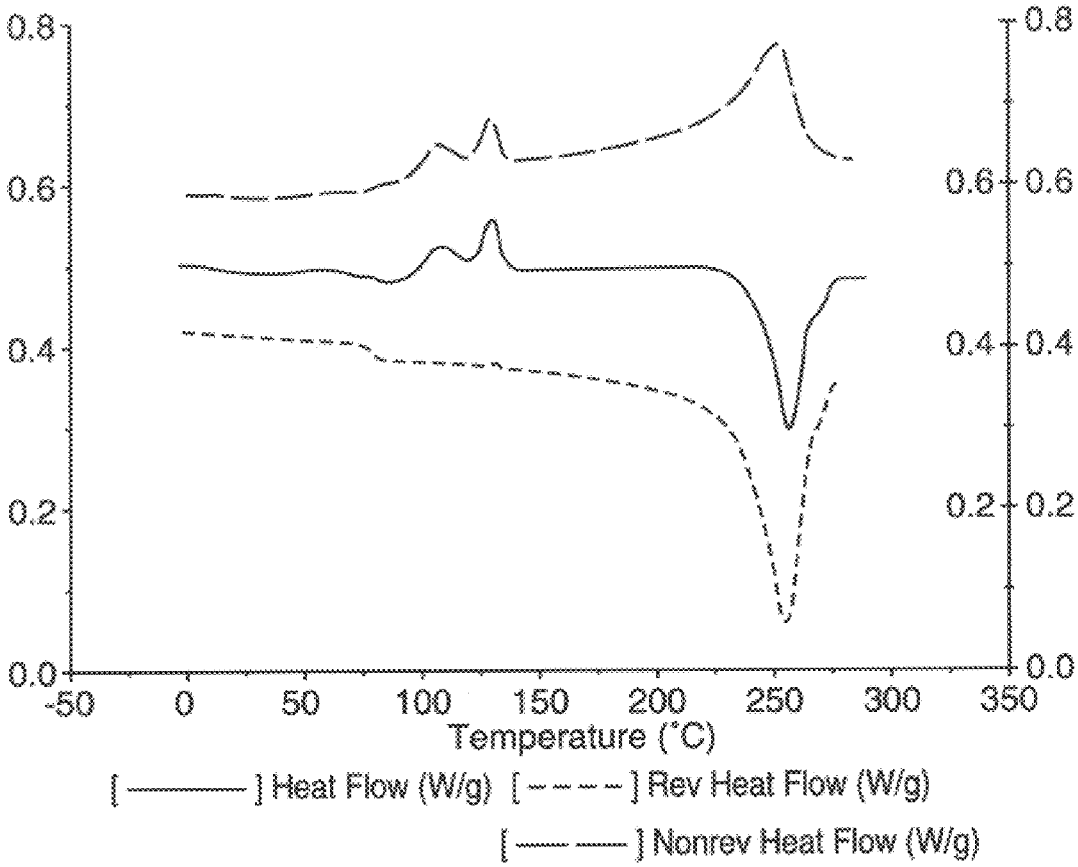
Figure 7:
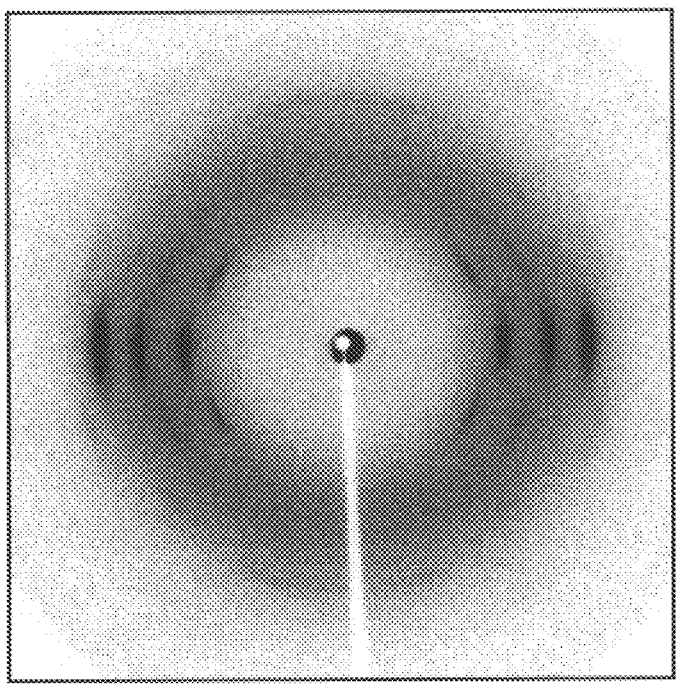

A differential scanning calorimetry plot, attached as FIG. 6, was generated for a representative fiber web of Example 10 using a Modulated DSC system (Model 2920 supplied by TA Instruments Inc, New Castle, Del.), and using a heating rate of 4 degrees C./minute, a perturbation amplitude of plus-or-minus 0.636 degrees C. and a period of 60 seconds. A WAXS diagram for fibers of Example 10, attached as FIG. 7, was collected by use of a Bruker microdiffractometer, copper K$\alpha$ radiation, and Hi-STAR 2D position sensitive detector registry of the scattered radiation (supplied by Bruker AXS, Inc, Madison, Wis.). The diffractometer was fitted with a 300 micron collimator and graphite incident beam monochromator. The X-ray generator consisted of a rotating anode source using a copper target operated at settings of 50 kV and 100 mA. Data were collected using a transmission geometry for 60 minutes with the detector centered at 0 degrees (2$\theta$) at a sample to detector distance of 6.0 cm. Samples were mounted so as to place the fiber direction in the vertical. The 2D detector data were corrected for detector sensitivity and spatial irregularities using the Bruker GADDS data analysis software.

TABLE 1

| | Extruder Temp. (C.) | Die Air Temp. (C.) | Die Air Pressure psi (kPa) | Air Velocity (m/sec) | % Shrinkage | EFD (microns) | Average Measured Diameter (microns) |
|---|---|---|---|---|---|---|---|
| 1 | 260 | 246 | 8 (55) | 173 | 6 | 30.6 | |
| 2 | 260 | 245 | 10 (69) | 199 | 4 | 31.0 | |
| 3 | 260 | 246 | 12 (83) | 222 | 3 | 30.0 | |

TABLE 1-continued

| | Extruder Temp. (C.) | Die Air Temp. (C.) | Die Air Pressure psi (kPa) | Air Velocity (m/sec) | % Shrinkage | EFD (microns) | Average Measured Diameter (microns) |
|---|---|---|---|---|---|---|---|
| 4 | 260 | 245 | 23 (159) | 331 | 0 | 30.2 | |
| 5 | 273 | 258 | 6 (41) | 144 | 3 | 18.1 | 10.2 |
| 6 | 273 | 258 | 8 (55) | 173 | 1 | 21.1 | 12.0 |
| 7 | 273 | 258 | 10 (69) | 204 | 1 | 21.0 | |
| 8 | 273 | 258 | 12 (83) | 227 | 1 | 21.4 | |
| 9 | 273 | 258 | 14 (97) | 249 | 1 | 22.9 | |
| 10 | 273 | 258 | 16 (110) | 271 | 1 | 23.2 | |
| 11 | 273 | 259 | 23 (159) | 335 | 0 | 26.3 | |
| 12 | 286 | 271 | 8 (55) | 182 | 1 | 11.7 | |
| 13 | 286 | 271 | 10 (69) | 201 | 0 | 9.1 | |
| 14 | 286 | 270 | 12 (83) | 226 | 0 | 9.4 | |
| 15 | 286 | 271 | 14 (97) | 263 | 1 | 9.0 | |
| 16 | 286 | 271 | 16 (110) | 272 | 1 | 10.2 | |
| 17 | 286 | 271 | 23 (159) | 343 | 3 | 14.1 | |

EXAMPLES 18–22

Figure 8:
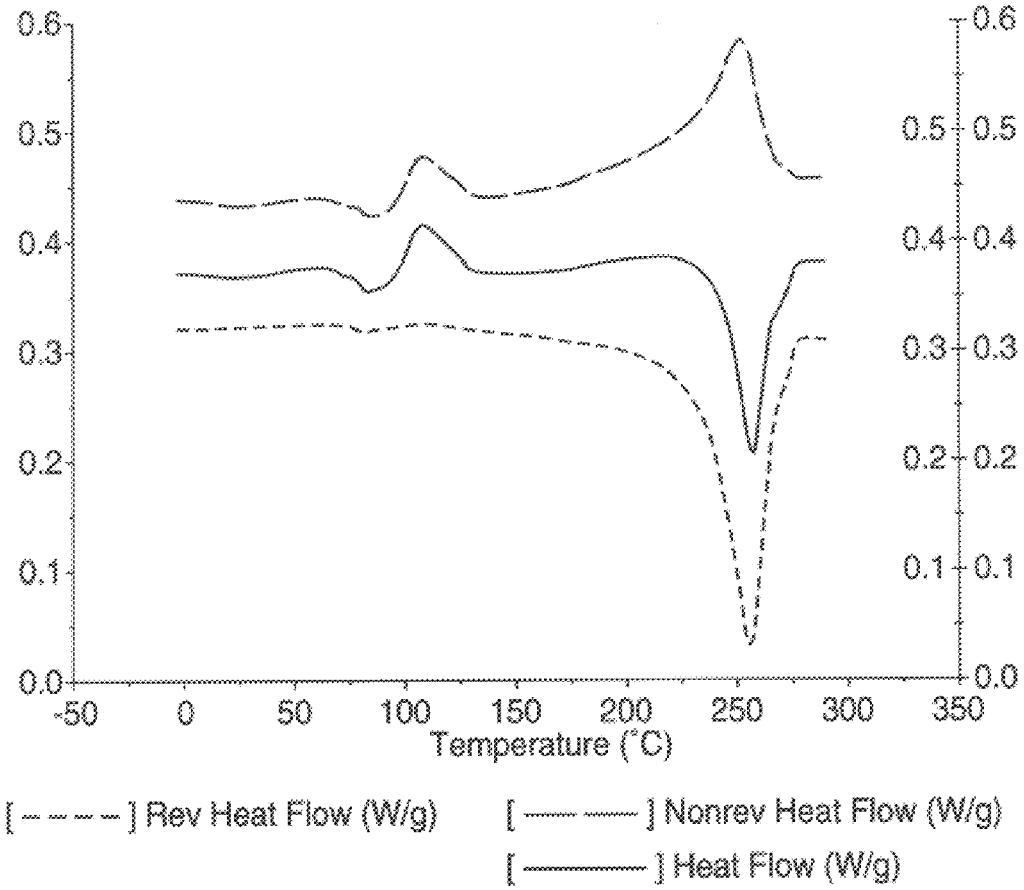
Figure 9:
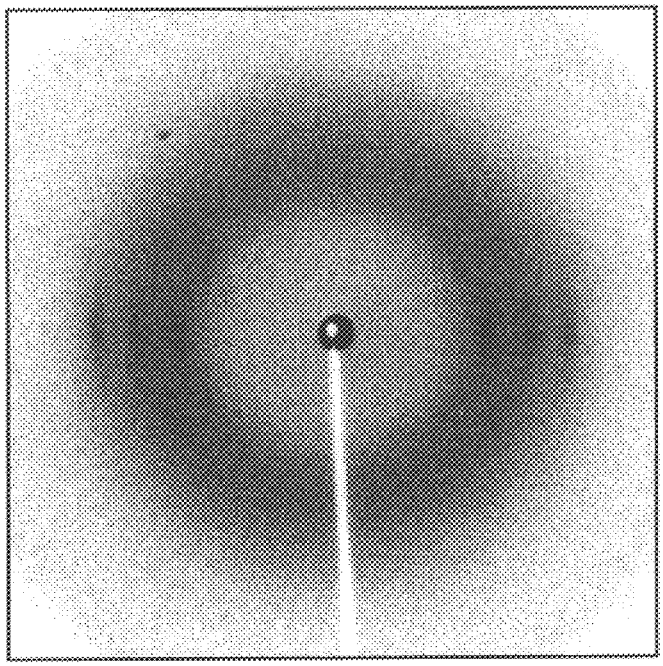

A different set of examples was prepared generally by the process described in Examples 1–17 except that the rate of polymer extruded was increased from 1 pound/inch/hour to 3 pounds/inch/hour (about 540 grams per centimeter per hour). Results are reported in Table 2. A DSC plot for representative fibers of Example 22 is pictured in FIG. 8, and a WAXS diagram for the fibers is pictured in FIG. 9.

TABLE 2

| Ex. | Extruder Temp. (C.) | Die Air Temp. (C.) | Die Air Pressure (psi) (KPa) | Air Velocity (m/sec) | % Shrinkage | EFD (microns) | Average Measured Diameter (microns) |
|---|---|---|---|---|---|---|---|
| 18 | 260 | 245 | 16 (110) | 271 | 6 | 23.4 | |
| 19 | 260 | 246 | 23 (159) | 331 | 3 | 22.8 | |
| 20 | 273 | 257 | 14 (97) | 250 | 3 | 21.7 | 10.23 |
| 21 | 273 | 257 | 16 (110) | 275 | 2 | 21.0 | |
| 22 | 273 | 258 | 23 (159) | 338 | 0 | 22.5 | |

EXAMPLES 23–36

Figure 3:
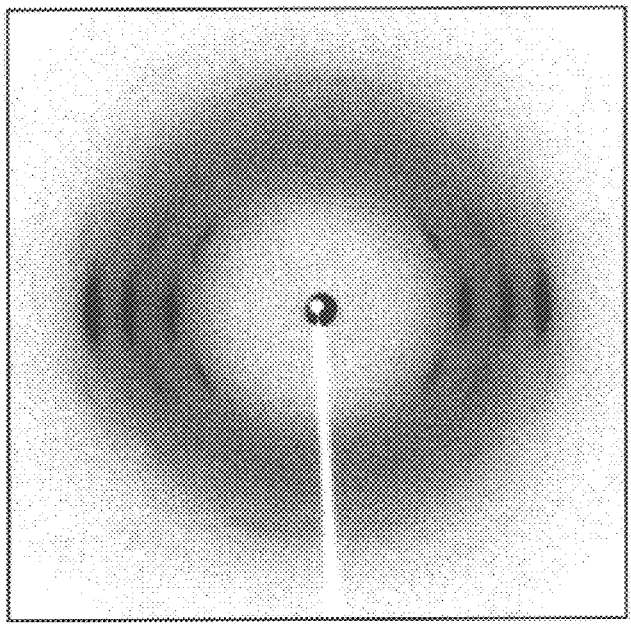
FIGS. 3, 5, 7 and 9 are WAXS diagrams for the fiber for which a DSC plot is pictured, respectively, in FIGS. 2, 4, 6 and 8.
Figure 5:
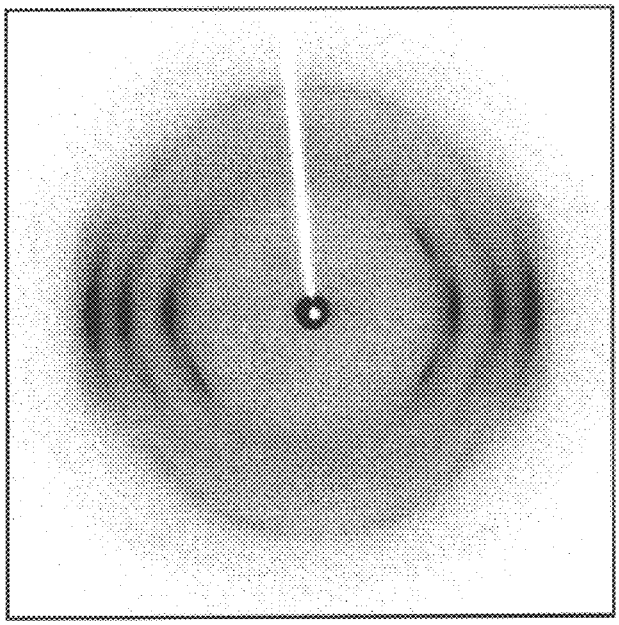

A different set of examples was prepared generally by the process described in Examples 1–17 except that polyethylene terephthalates of different molecular weight, or intrinsic viscosity, were used. Specifically, the PET used in Examples 23–31 had an intrinsic viscosity of 0.5, and the PET used in Examples 32–36 had an intrinsic viscosity of 0.45. Results are reported in Table 3. A DSC plot for a representative fiber of Example 31, as collected, is pictured in FIG. 2 and a WAXS diagram for that fiber is pictured in FIG. 3. A DSC plot for a representative fiber after the collected web was annealed at 160° C. for 5 minutes is pictured in FIG. 4, and a WAXS diagram for that fiber is pictured in FIG. 5. Note that the post-annealed fibers in FIG. 4 retain the dual melting peak. The WAXS diagram also indicates that after annealing, the SIC portion is retained and crystallinity has increased.

Atomic force micrographs of unannealed fibers like those made according to Example 31 were prepared using a scanning probe microscope (SPM supplied by Digital Instruments (Santa Barbara, Calif.) "Dimension 5000"). The fibers were imaged in tapping-mode AFM mode (TM-AFM) using silicon probes (OMCL-AC160TS, Olympus, Japan). Some fibers were then etched in an unstirred 30% NaOH solution for 5 hours, then rinsed copiously with de-ionized water. The fibers were air dried before imaging. The images (2.88 micrometer by 1.44 micrometer) were scanned in the longitudinal direction on the fiber (images perpendicular to the fiber direction (not shown) were also captured to confirm the directionality of the structures in the fiber direction). FIG. 11*a* shows the fiber before etching and FIG. 11*b* shows the fiber after etching.

TABLE 3

| Ex. | Extruder Temp. (C.) | Die Air Temp. (C.) | Die Air Pressure (psi) | PET IV | Air Velocity (m/sec) | % Shrinkage | EFD (microns) | Average Measured Diameter (microns) |
|---|---|---|---|---|---|---|---|---|
| 23 | 260 | 246 | 8 | 0.50 | 164 | 4 | 15.4 | 9.2 |
| 24 | 260 | 245 | 10 | 0.50 | 193 | 4 | 18.6 | |
| 25 | 260 | 245 | 12 | 0.50 | 210 | 3 | 17.9 | |
| 26 | 260 | 245 | 14 | 0.50 | 231 | 3 | 19.1 | |
| 27 | 260 | 245 | 16 | 0.50 | 261 | 3 | 18.6 | |
| 28 | 260 | 246 | 23 | 0.50 | 333 | 1 | 22.0 | |

TABLE 3-continued

| Ex. | Extruder Temp. (C.) | Die Air Temp. (C.) | Die Air Pressure (psi) | PET IV | Air Velocity (m/sec) | % Shrink-age | EFD (microns) | Average Measured Diameter (microns) |
|---|---|---|---|---|---|---|---|---|
| 29 | 273 | 259 | 12 | 0.50 | 220 | 8 | 9.0 | 6.3 |
| 30 | 273 | 259 | 14 | 0.50 | 239 | 1 | 8.4 | 6.5 |
| 31 | 273 | 259 | 16 | 0.50 | 262 | 1 | 9.1 | |
| 32 | 260 | 245 | 10 | 0.45 | 202 | 9 | 12.5 | |
| 33 | 260 | 244 | 12 | 0.45 | 211 | 6 | 13.5 | |
| 34 | 260 | 245 | 14 | 0.45 | 234 | 6 | 14.6 | |
| 35 | 260 | 246 | 16 | 0.45 | 255 | 8 | 13.5 | |
| 36 | 260 | 246 | 23 | 0.45 | 334 | 3 | 16.3 | |

EXAMPLE 37

A nonwoven fibrous web was prepared using two meltblowing dies vertically aligned one over the other and spaced 9 inches (23 cm) apart. The dies were angled 45 degrees to the centerline separating the two dies, so that the fiber streams from each die converged and merged in front of the dies. Both meltblowing dies were configured as described in Examples 1–17 with the exception that the width of the slots 15 (the dimension 21 in FIG. 1) was set at 0.060 inch (1.52 mm) and the die tip to air slot negative setback was 0.049 inch (1.25 mm). PET meltblown fibers were prepared on the first die from PET resin of 0.52 intrinsic viscosity extruded at a rate of 1.0 pounds/inch/hour. The processing temperature for the PET polymer was 273° C. The temperature of the attenuating air passing through the slot 15 was 255° C. The air pressure was set at 11 psi (76 kilopascal). Meltblown polyethylene fibers were prepared on the second die at a throughput rate of 0.4 pounds/inch/hour from polyethylene resin 6806 available from The Dow Chemical Company. The processing temperature for the polyethylene resin was set at 265° C. The temperature of the attenuating air passing through the slot 15 was 230° C. The air pressure was set at 3 psi (21 kilopascal).

A web comprising 71 weight-percent PET fibers and 29 weight- percent PE fibers was collected at a rate that produced a basis weight of about 377 grams/square meter. The collector was spaced 26 inches (66 cm) from the plane defined by the two meltblowing die tips.

Figure 12:
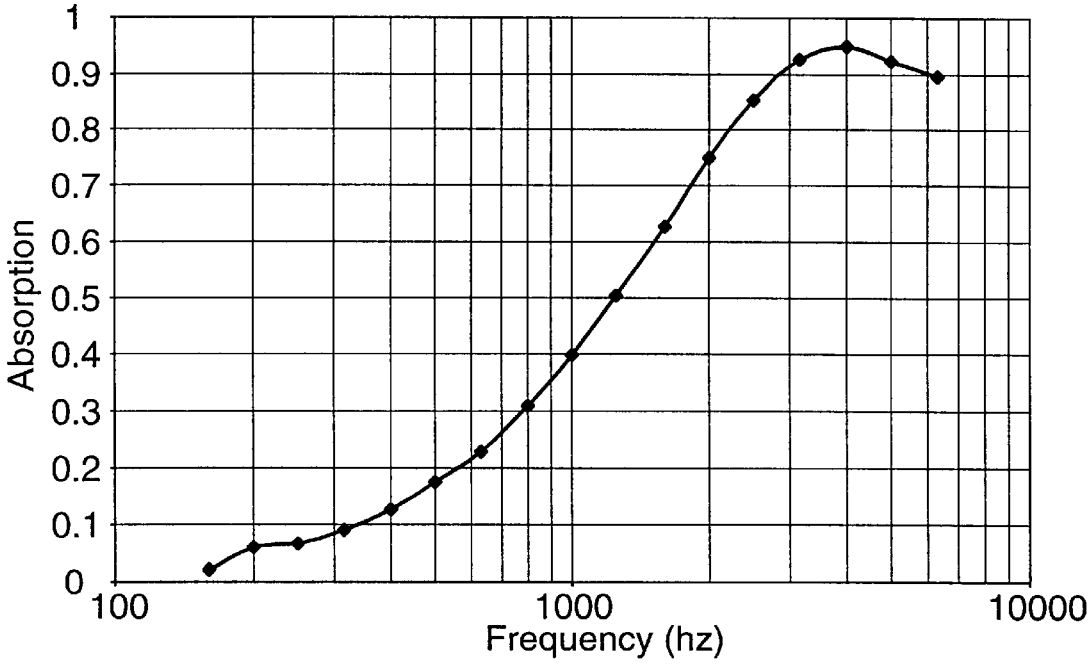
FIG. 12 is a plot of sound insulation values for a web of Example 37.

The prepared web was thermally bonded and annealed by heating in an oven at 160° C. for 5 minutes. The web was tested for sound absorption using an impedance tube as described in the ASTM E-1050 test method. The test was replicated once and the average results are reported in Table 4 and depicted in FIG. 12. The effective fiber diameter of the webs of Example 37 was about 13 micrometers, the webs had an average bulk density of about 14.6 kilograms per cubic meter, and the webs showed a pressure drop of about 1.2 mm water (based on tests of 6 sample webs) under the previously stated measurement conditions.

TABLE 4

| Frequency (hz) | 160 | 200 | 250 | 315 | 400 | 500 | 630 | 800 | 1000 | 1250 | 1600 | 2000 | 2500 | 3150 | 4000 | 5000 | 6300 |
|---|---|---|---|---|---|---|---|---|---|---|---|---|---|---|---|---|---|
| % Absorption Coefficient | 2.10 | 5.95 | 6.70 | 9.15 | 12.65 | 17.50 | 22.90 | 30.90 | 39.95 | 50.40 | 62.70 | 75.00 | 85.40 | 92.75 | 94.90 | 92.35 | 89.70 |

EXAMPLES 38–40

A series of webs of the invention were prepared from PET having an intrinsic viscosity of 0.05 using a meltblown die as described in Examples 1–17. The processing temperature for the PET ploymer was set to 273° C. and the temperature of the air passing through the slot 15 was set to 258° C. The collector was set as described in Examples 1–17 to produce a web of about 260 grams/square meter. The webs were annealed at 160 degrees C for 5 minutes and then measured for tensile properties using tests as described in ASTM D 5034 (maximum load, in pounds-force) in the machine direction and using an Instron Tensile Tester (Model 4302) at a seperation rate of 12 inches/minute (30.48 cm/minute). The jaw gap was set to 0.25 inches (0.64 cm) and the sample width was 1.0 inch (2.54 cm). The test was based on 5 samples and the average results are reported in Table 5.

TABLE 5

| Ex. | Die Air Pressure (psi) (kPa) | Air Pressure Drop @ 3.12 m/min Face Velocity (mm H2O) | Web Basis Weight (g/m2) | EFD (microns) | m.d. Max. Load Avg. lb/in (N/m) |
|---|---|---|---|---|---|
| 38 | 12 (83) | 3.30 | 255 | 9.0 | 120 (21,000) |
| 39 | 14 (97) | 3.14 | 230 | 8.4 | 128 (22,400) |
| 40 | 16 (110) | 3.26 | 299 | 9.1 | 128 (22,400) |

EXAMPLES 41–42

Two nonwoven, fibrous composite webs comprising meltblown fibers and staple fibers were prepared as described in U.S. Pat. No. 4,118,531 (Hauser). The webs included meltblown PET microfibers prepared from PET resin having an intrinsic viscosity of 0.52 and using a meltblowing die generally as illustrated in FIG. 1 and as described generally in Examples 1–17, but of a 47-inch (119 centimeter) width and a combined width of the slots 15 (the dimension 21) of 0.059 inch (1.5 mm). The webs also included a mixture of staple crimped bulking fibers and bicomponent thermobonding staple fibers (Example 41) or just bicomponent thermobonding staple fibers (Example 42). More specifically, Example 41 comprised 63% PET meltblown fibers, 18.5% 6-denier polyester staple fiber (Type 295 of 1.5-inch length available from KoSa), and 18.5% bicomponent thermobonding fiber (Type T-257 available from KoSa). The basis weight of the collected combination web was 280 grams per square meter. Example 42 comprised 80% PET meltblown fibers, and 20% bicomponent 1.5-inch long thermobonding fiber (Type T-252 available from KoSa). The basis weight of the collected combination web was 275 grams per square meter.

The collected webs were thermally bonded and annealed by heating in a conveyor oven at 160 degrees C. for one minute, after which the webs were sewn between pieces of rip-stop nylon to prepare twenty-two inch square samples. The webs were washed or laundered in a front-loading washer (UNIMAC Model UF50) with a water temperature of 170° C. and then dried. This was repeated for 50 cycles. Prior to laundering, the thermal insulation value was measured in clo as described in ASTM D1518 and measured again after the $50^{th}$ washing cycle. The web thickness was measured before and after the 50 laundering cycles as described in ASTM D5736 using a pressure plate force of 0.002 pound per square inch. The percent thickness loss is reported. Both exemplary webs passed the visual test for durability and the results are set forth in Table 6.

TABLE 6

| Example | CLO Before 50 Wash Cycles | CLO After 50 Wash Cycles | % Thickness Loss |
|---|---|---|---|
| 42 | 2.6 | 1.7 | 45 |
| 43 | 2.2 | 1.3 | 29 |

What is claimed is:

1. A fibrous nonwoven web comprising a mass of polyethylene terephthalate fibers that exhibit a double melting peak on a DSC plot, one peak being representative of a first molecular portion within the fiber that is in non-chain-extended crystalline form, and the other peak being representative of a second molecular portion within the fiber that is in chain-extended crystalline form and has a melting point elevated over that of the non-chain-extended crystalline form, the fibers being autogenously bonded at points of fiber intersection.

2. A nonwoven web of claim 1 that has been annealed, as indicated by the absence of a cold-crystallization peak on the DSC plot.

3. A web of claim 1 in which the PET fibers are prepared from resin exhibiting an intrinsic viscosity of between about 0.45 and 0.75.

4. A web of claim 1 in which the PET fibers are prepared from resin exhibiting an intrinsic viscosity of about 0.6 or less.

5. A web of claim 1 in which the average diameter of the PET fibers is about 20 micrometers or less.

6. A web of claim 1 in which the average diameter of the PET fibers is about 10 micrometers or less.

7. A web of claim 1 in which the PET fibers include a circumferential layer of amorphous polymeric material.

8. A web of claim 1 that shrinks less than 5% when heated to a temperature of 160 degrees C. for 5 minutes.

9. A web of claim 1 that comprises other fibers interspersed among the PET fibers.

10. A web of claim 1 that comprises staple fibers interspersed among the PET fibers.

11. A web of claim 1 having a density of 100 kilograms per cubic meter or less.

12. A web of claim 1 having a thickness of at least 5 mm.

13. A web of claim 1 having a pressure drop of at least about 0.3 mm water pressure at a flow rate of 32 liters/minute and a face velocity of 3.12 meters per minute.

14. A web of claim 1 having a pressure drop of at least about 0.5 mm water pressure at a flow rate of 32 liters/minute and a face velocity of 3.12 meters per minute and a density of 50 kilograms per cubic meter or less.

15. A web of claim 1 in which the PET fibers are bicomponent in nature and include at least one polymeric component other than PET, the PET component extending longitudinally along the fiber through a first portion of the cross-sectional area of the fibers and exhibiting a double melting peak on a DSC plot, and the at least one other polymeric component extending longitudinally along the fiber through a second portion of the cross-sectional area of the fibers.

16. A fibrous nonwoven web comprising a mass of polyethylene terephthalate fibers that exhibit a double melting peak on a DSC plot, one peak being representative of a first molecular portion within the fiber that is in non-chain-extended crystalline form, and the other peak being representative of a second molecular portion within the fiber that is in chain-extended crystalline form and has a melting point elevated over that of the non-chain-extended crystalline form; the web being annealed, as indicated by the absence of a cold-crystallization peak on the DSC plot; and the web exhibiting a shrinkage of less than 5% when heated to a temperature of 160 degrees C. for 5 minutes, and further exhibiting continuing strength, toughness and flexibility after storage at ambient conditions.

17. A web of claim 16 in which the PET fibers have a circumferential layer of amorphous polymeric material by which the PET fibers are autogenously bonded at points of fiber intersection.

18. A web of claim 16 in which the average diameter of the PET fibers is about 20 micrometers or less.

19. A web of claim 16 in which the average diameter of the PET fibers is about 10 micrometers or less.

20. A web of claim 16 that comprises other fibers interspersed among the PET fibers.

21. A web of claim 16 that comprises staple fibers interspersed among the PET fibers.

22. A web of claim 16 having a density of 50 kilograms per cubic meter or less.

23. A web of claim 16 having a thickness of at least 10 mm.

24. A web of claim 16 having a pressure drop of at least about 0.5 mm water pressure at a flow rate of 32 liters/minute and a face velocity of 3.12 meters per minute.

25. A dimensionally stable fibrous nonwoven web comprising a coherent mass of entangled self-bonded meltblown polyethylene terephthalate fibers that exhibit a double melting peak on a DSC plot, the first peak being representative of a first molecular portion within the fiber that is in non-chain-extended crystalline form, and the other peak being representative of a second molecular portion within the fiber that is in chain-extended crystalline form and has a melting point elevated over that of the non-chain-extended crystalline form; the mass of PET fibers having an average diameter of about 20 micrometers or less, and the web having a density less than about 100 kilograms per cubic meter, a thickness of at least about 5 mm and a pressure drop of at least about 0.3 mm of water at a flow rate of 32 liters/minute and a face velocity of 3.12 meters per minute.

26. A nonwoven web of claim 25 that has been annealed, as indicated by the absence of a cold-crystallization peak on the DSC plot.

27. A web of claim 25 that shrinks less than 5% when heated to a temperature of 160 degrees C. for 5 minutes.

28. A web of claim 25 in which the PET fibers average 10 micrometers or less in diameter and the web has a pressure drop of at least 0.5 mm water pressure at a flow rate of 32 liters/minute and a face velocity of 3.12 meters per minute, a density of 50 kilograms per cubic meter or less, and a thickness of at least 10 millimeters.

29. A web of claim 25 in which the PET fibers are prepared from resin exhibiting an intrinsic viscosity of between about 0.45 and 0.6.

* * * * *

UNITED STATES PATENT AND TRADEMARK OFFICE

CERTIFICATE OF CORRECTION

PATENT NO. : 6,667,254 B1
DATED : December 23, 2003
INVENTOR(S) : Thompson, Delton R. Jr.

It is certified that error appears in the above-identified patent and that said Letters Patent is hereby corrected as shown below:

Title page,
Item [56], References Cited, OTHER PUBLICATIONS, delete "Astracts" and insert -- Abstracts --, therefor.

Column 14,
Line 34, delete "0.05" and insert -- 0.50 --, therefor.
Line 36, delete "polymer" and insert -- polymer --, therefor.
Line 45, delete "separation" and insert -- separation --, therefor.

Signed and Sealed this

Seventeenth Day of August, 2004

JON W. DUDAS
*Acting Director of the United States Patent and Trademark Office*